United States Patent [19]

Kimura

[11] Patent Number: 4,557,483

[45] Date of Patent: Dec. 10, 1985

[54] BALL SHOOTING APPARATUS FOR PINBALL GAME MACHINE

[75] Inventor: Yutaka Kimura, Osaka, Japan

[73] Assignee: Kabushiki Kaisha Universal, Tochigi, Japan

[21] Appl. No.: 644,130

[22] Filed: Aug. 24, 1984

[30] Foreign Application Priority Data

Aug. 24, 1983 [JP] Japan ..... 58-129789[U]

[51] Int. Cl.[4] ..... A63F 7/26

[52] U.S. Cl. ..... 273/129 S; 273/121 A

[58] Field of Search ..... 273/119 A, 120 A, 121 A, 273/129 R, 129 S; 361/154, 208; 124/54

[56] References Cited

U.S. PATENT DOCUMENTS 4,384,716 5/1983 Powers ..... 273/121 A
4,424,970 1/1984 Halliburton et al. ..... 273/121 A
4,437,664 3/1984 Wiczer et al. ..... 273/121 A
4,488,724 12/1984 Peters ..... 273/129 S

*Primary Examiner*—Richard C. Pinkham
*Assistant Examiner*—Vincent A. Mosconi
*Attorney, Agent, or Firm*—Young & Thompson

[57] ABSTRACT

Two cylindrical stator magnetic poles are disposed with a suitable space therebetween, and a plunger is movably disposed within the two stator magnetic poles. A coil is wound around the outer periphery of the two stator magnetic poles, and a current flowing in the coil causes the plunger to advance forward. The current flow is interrupted before the plunger reaches the intermediate position between the two stator magnetic poles, and the plunger thereafter further advances by inertia and strikes a ball. After the ball is struck, the coil is again supplied with a current, and the plunger is in turn supplied with a magnetic force in a retreat direction.

9 Claims, 12 Drawing Figures

BALL SHOOTING APPARATUS FOR PINBALL GAME MACHINE

FIELD OF THE INVENTION

The present invention relates to a ball shooting apparatus for a pinball game machine, and more particularly it relates to an apparatus used with a pinball game machine, such as a flipper game machine, pachinko machine or the like for magnetically shooting a ball from a launching position of such a machine.

DESCRIPTION OF THE PRIOR ART

A pinball game machine is provided with a ball shooting apparatus which is manipulated by a player. With this ball shooting apparatus, a ball is shot forward onto a playing field or playing board. A conventional ball shooting apparatus known in the art, as described in Japanese Utility Model Publ. No. 57-45032, uses a motor with a speed reducer. The rotary shaft of the motor has an arm fixedly connected thereto. The arm is pivoted to swing a hammer mounted pivotally on the back of a playing field, and the hammer in turn strikes a ball in a launching position. With such an apparatus, by slightly turning an adjustment knob on a manipulating panel, a power switch is turned on which is arranged in engagement with the knob. Thus, the motor with a speed reducer is caused to start. As a spring is set between the adjustment knob and the hammer, upon disengagement of the tip of the arm from a portion of the hammer, the hammer is rapidly returned to its original position by the stored energy of the spring, and the ball is struck. Since the spring is set such that the stored energy increases in proportion to the amount of rotation of the adjustment knob, the larger the amount of rotation, the stronger the force with which the ball is hit, and therefore the ball is shot at a high speed. The ball shooting apparatus as above, however, needs a large space due to the use of a motor with a speed reducer. Furthermore, in order to adjust the shooting force upon a ball, it is necessary to turn the adjustment knob against the spring force.

In order to solve the problems of the motor having a speed reducer, a method for electromagnetically controlling the movement of a hammer by means of a solenoid has been disclosed, for example, in Japanese Patent Laid-Open Publ. No. 56-8081. With this electromagnetic controlling method, however, a first and a second coil are required, the former being for advancing the hammer toward the ball and the latter being for returning or withdrawing the hammer after it has shot the ball. Furthermore, since the adjustment of a striking force upon the ball is effected in accordance with a voltage amplitude applied to the first coil, a complicated circuit for adjusting the voltage amplitude is required.

SUMMARY OF THE INVENTION

It is therefore a principal object of the present invention to provide a ball shooting apparatus for a pinball game machine of a simple construction and a low cost.

It is another object of the present invention to provide a ball shooting apparatus which can effect the shooting of a ball by using a single coil.

It is a further object of the present invention to provide a ball shooting apparatus in which an adjustment of striking force is performed with ease.

It is a still further object of the present invention to provide a ball shooting apparatus in which an adjustment of striking force can be achieved with only an alteration of a current-supplying interval to a coil, and in which variation of voltage applied to the coil does not have an adverse effect upon the adjustment.

Finally, it is an object of the present invention to provide a ball shooting apparatus in which a reciprocating motion of a plunger which strikes a ball can be obtained by conducting current twice through a single coil.

In order to attain the above objects and other objects and advantages of the present invention, a plunger is inserted into two cylindrical stator magnetic poles which are disposed with a suitable space therebetween, and a single coil is disposed at an outer periphery of the two stator magnetic poles. When a current is made to flow through the coil, an electromagnetic force is produced such that the plunger is forced to return to an intermediate position between the two stator magnetic poles. Thus, even if the current flow through the coil is interrupted when the plunger reaches the intermediate position or a position a little before the intermediate position, after that time the plunger still goes on moving because of inertia. The thuscontinued forward stroke of the plunger causes the ball to be struck.

DETAILED DESCRIPTION OF THE PREFERRED EMBODIMENT

Figure 1:
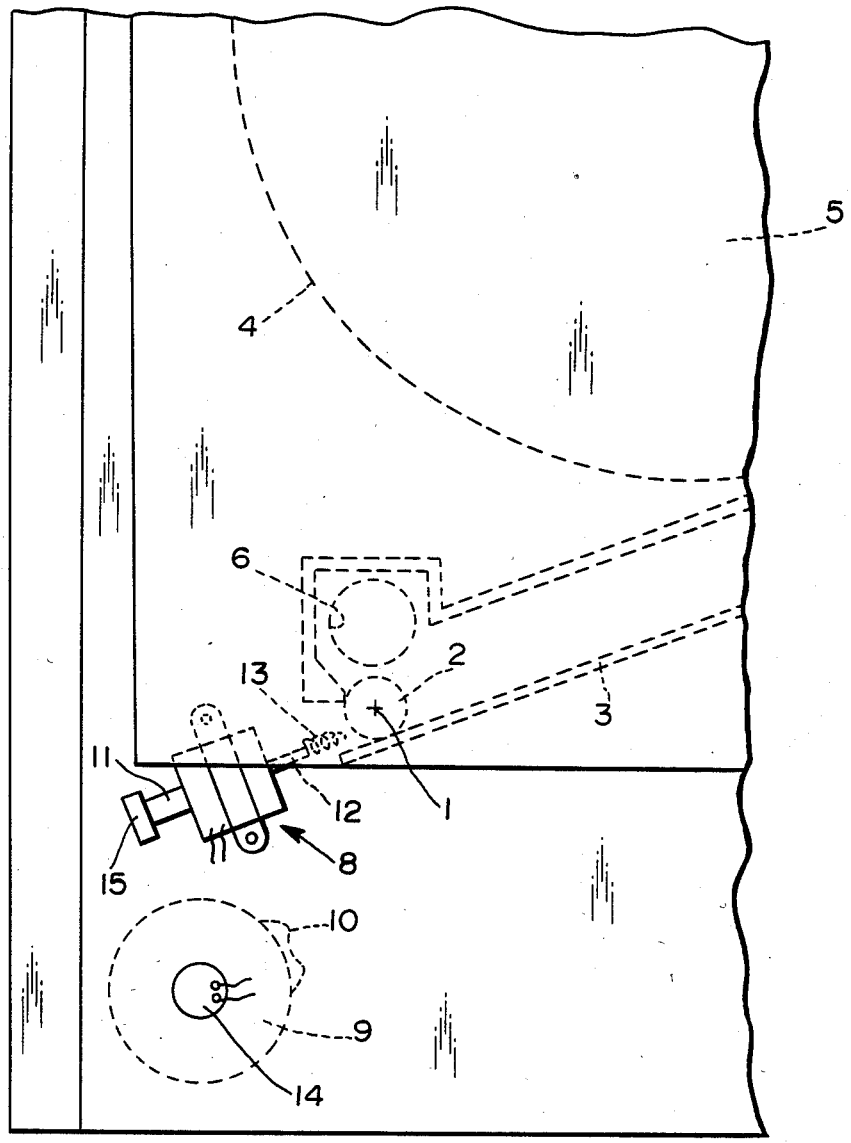
FIG. 1 is a bottom plan view of a pinball game machine embodying the present invention.

Referring now to FIG. 1 which shows a part of the bottom plan view of a pinball game machine, after a ball 2 at a launching position 1 depicted as a cross mark has been shot via a guide rail 3 onto a playing field 5 surrounded by a frame 4, one of the balls contained in a ball vessel (not shown) is taken out therefrom, and is fed through an aperture 6 to the launching position 1. In order to strike the ball 2 at the launching position 1 and to shoot it onto the playing field 5, a solenoid 8 is provided. A plunger (moving body) 11 of the solenoid moves forward when a start switch 10 mounted on the outer periphery of a manipulating knob 9 is pushed and is rendered in an ON state. The plunger 11 has a hammer 12 fixedly connected to the top thereof, and the hammer 12 has a conical spring 13 mounted on the tip thereof. The spring 13 serves to damp the impact force generated when the ball 2 is struck. The adjustment of striking force upon the ball, that is, the adjustment of shooting force upon the ball, is carried out by rotating the manipulator knob 9 which changes the resistance value of a rotary-type variable resistor 14. The solenoid 8 is disposed slantwise in alignment with the guide rail 3. During the time when the solenoid 8 is not energized, the plunger 11 rests against a stopper 15 due to the force of gravity.

Figure 2:
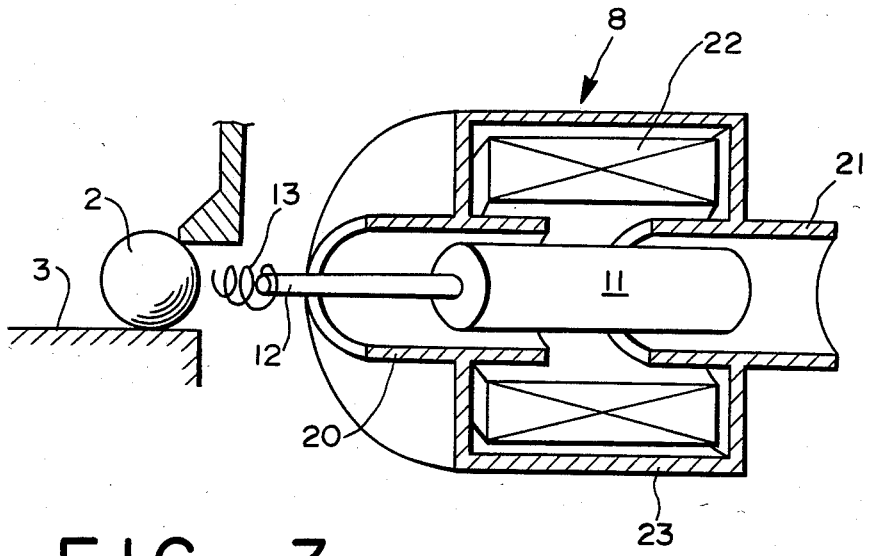
FIG. 2 is a cross sectional view of an embodiment according to the present invention.

As shown in FIG. 2, the solenoid 8 comprises stator magnetic poles 20 and 21, the plunger 11, a coil 22, and an envelope 23. The stator magnetic poles 20 and 21 are of a cylindrical shape and are disposed coaxially with a suitable space therebetween. The plunger 11 is so formed as to slide freely along the interior of the stator magnetic poles 20 and 21. The coil 22 is disposed at the outer periphery of the stator magnetic poles 20 and 21, and symmetrically supplies magnetic fields to the stator magnetic poles 20 and 21. The envelope 23 covers the coil 22 and magnetically couples the stator magnetic poles 20 and 21. The stator magnetic poles 20 and 21, plunger 11 and envelope 23 are all made of ferromagnetic material such as iron.

Figure 3:
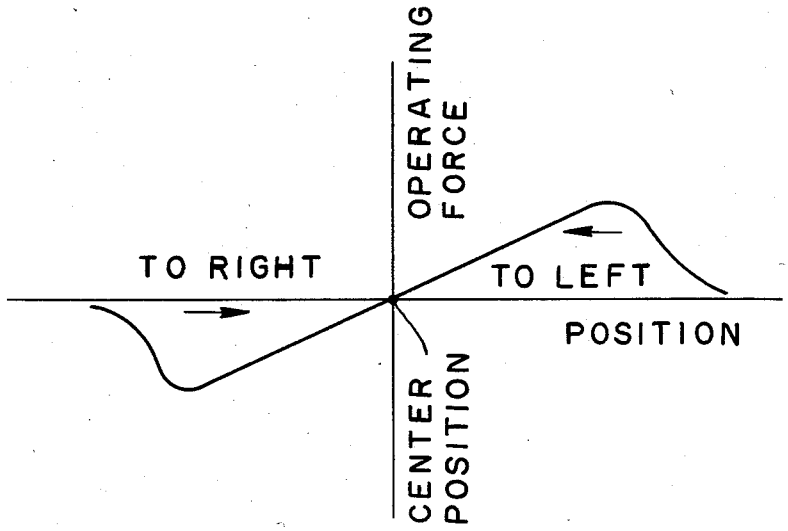
FIG. 3 is a graph showing a magnetizing current supplied to a coil and an operating force of a plunger.

In FIG. 3, the operating force of the plunger 11 relative to its position, while the coil of the solenoid 8 is carrying a magnetizing current, is shown. In particular, when the plunger 11 is at an intermediate position between the stator magnetic poles 20 and 21, no operating force is generated. When the plunger 11 is on the side of the right-hand stator magnetic pole 21, then it receives a force causing it to move to the left, and when the plunger 11 is on the side of the lefthand stator magnetic pole 20, then it receives a force causing it to move to the right. Therefore, if the coil 22 is continuously fed with a current, the plunger 11 stops at the intermediate position between the stator magnetic poles 20 and 21.

Figure 4:
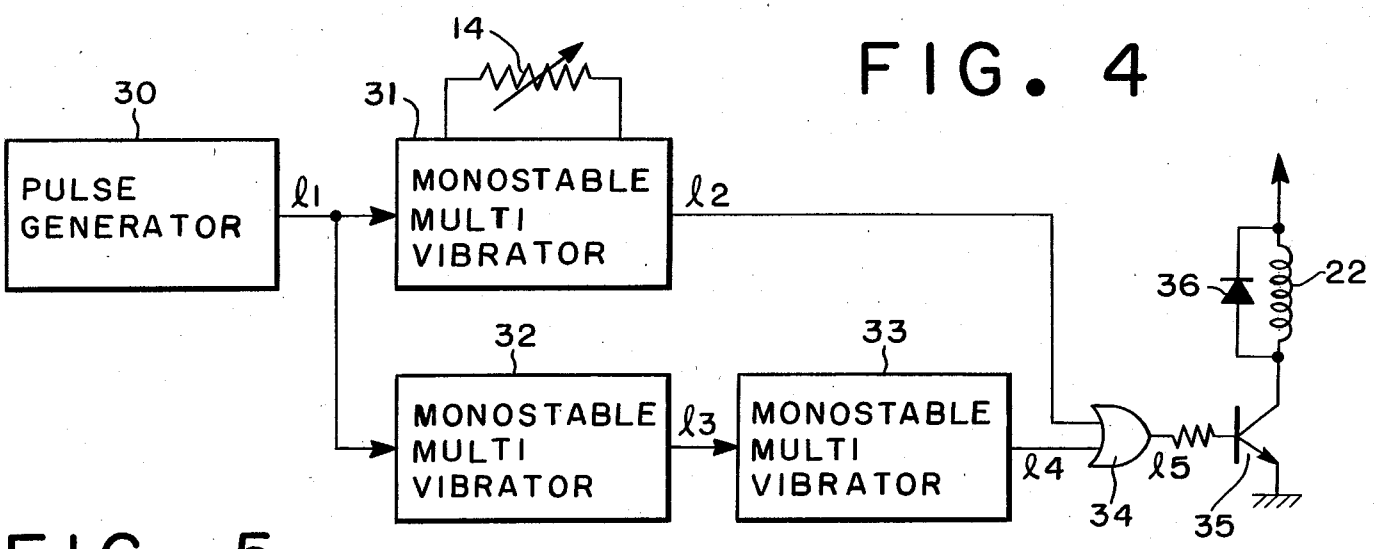
FIG. 4 is a block diagram of a control circuit for controlling a current flow in a coil.

As shown in FIG. 4, a control circuit for controlling the current flow in the coil 22 comprises a pulse generator 30, monostable multivibrators 31, 32, and 33, an OR circuit 34, and a transistor 35. The pulse generator 30 oscillates at a predetermined frequency corresponding to the shooting of the balls. The monostable multivibrators 31 and 32 are triggered by a trailing edge of a pulse from the pulse generator 30, and the monostable multivibrator 33 is triggered by a trailing edge of a pulse from the monostable multivibrator 32. The OR circuit 34 is supplied with the outputs from the monostable multivibrators 31 and 33. The transistor 35 has a base connected to the output terminal of the OR circuit 34, and has the coil connected in series thereto in order to magnetize the coil while the transistor 35 is in the ON position.

Figure 5:
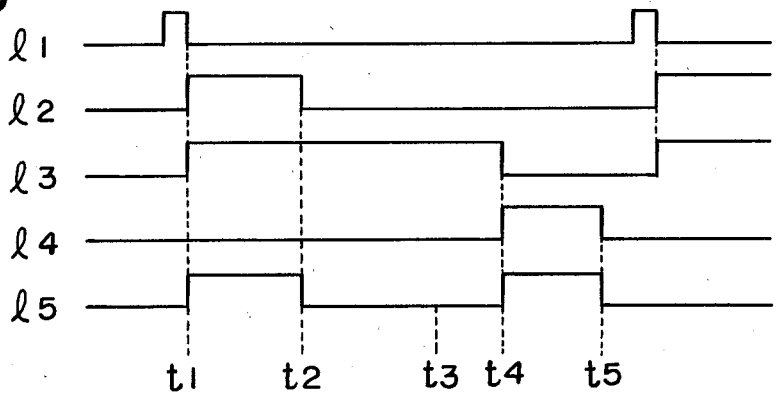
FIG. 5 is a timing chart illustrating the operation of the control circuit shown in FIG. 4.

The timing chart of the output waveforms on each output line $l_1$ through $l_5$ of the control circuit shown in FIG. 4 is shown in FIG. 5. t1 designates the instant when a current starts to flow through the coil 22, t2 designates the instant when current stops flowing through the coil 22, and a time period between these instants (t1−t2) serves to adjust the operating force of the plunger 11, that is, the striking force upon the ball. The time difference (t1−t2) is adjusted with the variable resistor 14 shown in FIG. 1. t3 designates the instant when the ball 2 is shot by the hammer 12 mounted on the tip of the plunger 11. t4 which is determined by the monostable multivibrator 32 represents the instant when the coil 22 is again supplied with a current thereby exerting a restoring force on the plunger 11 and initiating the start of damping of the sliding plunger 11. The damping force is adjusted by a time period (t5−t4) to be determined by the monostable multivibrator 33. The retreat of the plunger 11 can be started by setting the time period (t5−t4) appropriately.

Figure 6:
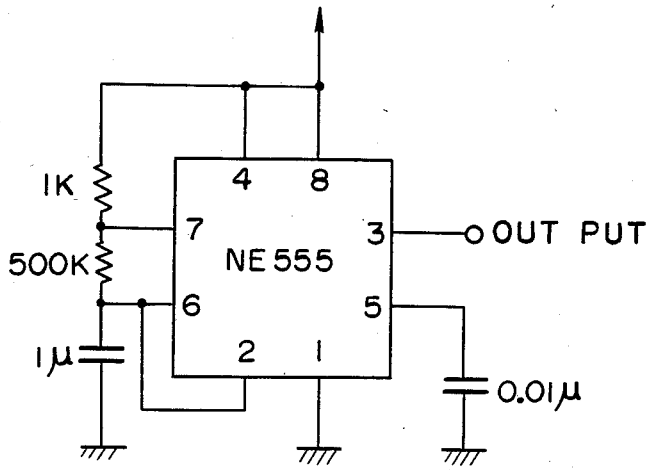
FIG. 6 is a circuit diagram of an embodiment of the pulse generator shown in FIG. 4.
Figure 7:
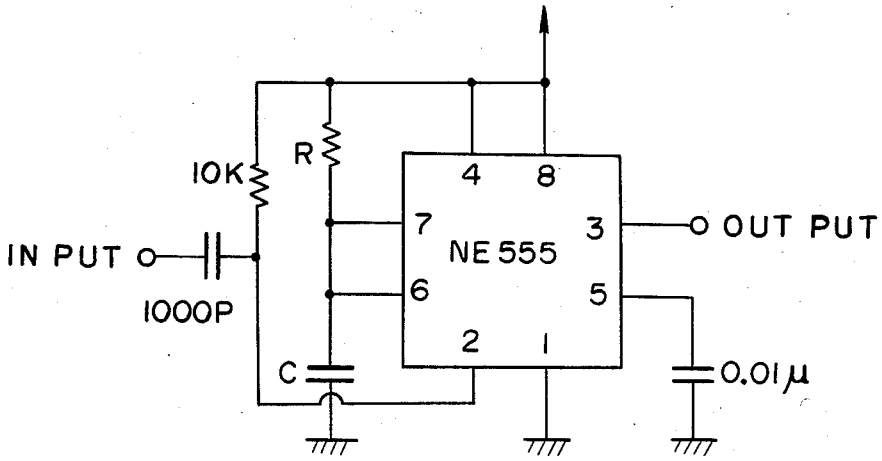
FIG. 7 is a circuit diagram of an embodiment of the monostable multivibrator shown in FIG. 4.

FIG. 6 is a circuit example of the pulse generator 30, in which an astable multivibrator constructed of NE555, known as a timer IC, and a pulse period (occurence of shootings) determined by the resistor and capacitor connected to second, sixth, and seventh terminals of the IC are featured. FIG. 7 is a circuit example of the monostable multivibrators 31 through 33, in which a trigger is activated when a trailing edge of a pulse enters the second terminal through a differentiation circuit, and an ON time is determined by a time constant circuit connected to the sixth and seventh terminals. In the monostable multivibrator 31, the variable resistor 14 shown in FIG. 1 is used as a resistor R in FIG. 7, and the pulse width is determined by the resistance value of the variable resistor 14.

Figure 8:
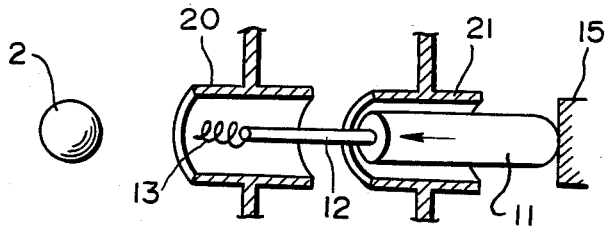
FIG. 8 is a series of cross sectional views illustrating the operation of an embodiment according to the present invention.
Figure 8:
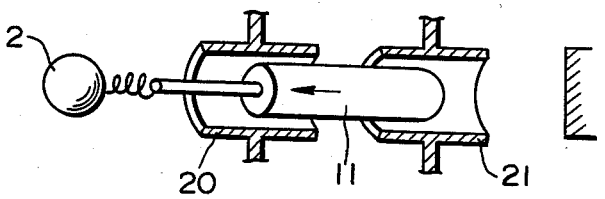
Figure 8:
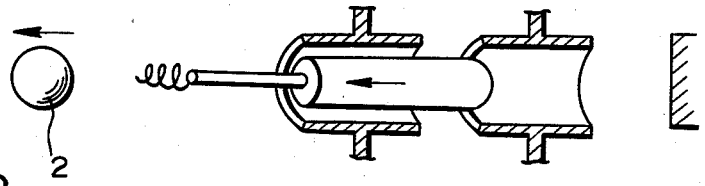
Figure 8:
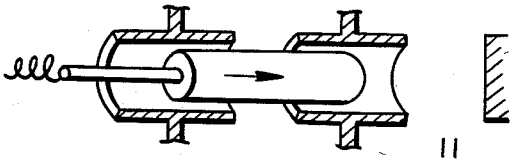
Figure 8:
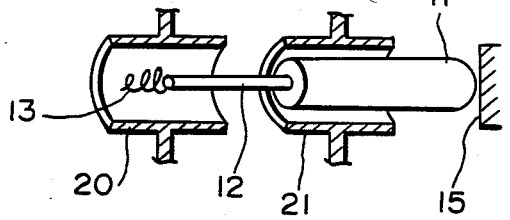

FIG. 8 illustrates the operation of the present invention. The player pushes the start switch 10 of FIG. 1 to the ON position, and the control circuit shown in FIG. 4 is supplied with a current and begins operation. At this instant, since the solenoid 8 is disposed slightly slantwise, the plunger 11 is on the side of the stator magnetic pole 21. Then, by a first trailing edge of a pulse from the pulse generator 30, the monostable multivibrator 31 is triggered, and the coil 22 is supplied with a current through the OR circuit 34 and the transistor 35. As a result of the current flow in the coil 22, a magnetic force is generated in a left hand direction thereby making the plunger 11 start to slide to the left.

When the plunger 11 reaches or nears the intermediate position, the current passing through the coil 22 is interrupted. The period during which a current is supplied to the coil 22 is determined to be the off time of the monostable multivibrator 31, which, through the variable resistor 14, is controlled by turning the manipulation knob 9. When the current flow in the coil 22 stops, the magnetic force becomes zero; however, the plunger 11 continues to slide with inertia, without receiving a force, back to its original position. The hammer 12 collides with the ball 2 which in turn is ejected.

Following the ejection of the ball, the plunger 11 of the solenoid 8 continues to move, with energy remaining in the plunger 11 after collision with the ball 2. After the plunger 11 passes through the intermediate position to the left, the coil 22 is again supplied with a current by the turning off of the monostable multivibrator 32. Then, the plunger 11 this time receives a force causing the plunger to move to the right, so that the plunger 11 is damped. It is to be noted here that since the plunger 11 has lost almost all of its kinetic energy due to the collision with the ball 2, the plunger 11 can be stopped immediately. By suitably adjusting the second current-supplying interval (a turn-off period of the monostable multivibrator 33), the plunger 11 can be returned to the right after its reception of the damping force, and is stopped at the initial position on the stopper 15. The collision energy of the plunger 11 with the stopper 15 may be reduced by adjusting the second current-supplying interval. Thereafter, with another trailing edge of a pulse from the pulse generator 30, the foregoing operation may be repeated, thereby enabling one to shoot a number of balls one after another.

What is claimed is:

1. A ball shooting apparatus for a pinball game machine for striking and shooting a ball comprising:

first and second cylindrical stator magnetic poles disposed coaxially with a space therebetween;

a coil supplying said first and second stator magnetic poles with a symmetrical magnetic field;

an envelope of a ferromagnetic material covering said coil and magnetically coupling said first and second stator magnetic poles;

a plunger coaxial with and disposed within said first and second stator magnetic poles, said plunger moving, by a magnetic force generated when said coil is supplied with electrical current, between an advanced position wherein said plunger is on the side of said first stator magnetic pole which is opposite said second pole, an intermediate position wherein said plunger is between said first and second stator poles, and a retracted position wherein said plunger is on the side of said second stator magnetic pole which is opposite said first pole, said plunger striking said ball while said plunger moves toward said advanced position; and a control circuit supplying a first current for an interval to said coil when said plunger is in said retracted position, said circuit interrupting said first current before said plunger substantially reaches said intermediate position and damping and withdrawing said plunger by supplying a second current for an interval to said coil after said plunger passes through said intermediate position.

2. A ball shooting apparatus for a pinball game machine as set forth in claim 1, in which said first and second stator magnetic poles are disposed slantwise so that said plunger may move toward said retracted position by the force of gravity.

3. A ball shooting apparatus for a pinball game machine as set forth in claim 1, and a hammer fixedly coupled with the tip of said plunger.

4. A ball shooting apparatus for a pinball game machine as set forth in claim 3, and a coil spring mounted on the tip of said hammer.

5. A ball shooting apparatus for a pinball game machine as set forth in claim 1, and a stopper for stopping said plunger at said retracted position.

6. A ball shooting apparatus for a pinball game machine as set forth in claim 1, in which said control circuit comprises:

a pulse generator for generating a first pulse synchronized with a predetermined period;

a first monostable multivibrator having an output terminal and generating, by being triggered by said first pulse, a second pulse having a pulse width corresponding to said interval of said first current;

a second monostable multivibrator generating, by being triggered by said first pulse, a third pulse after the generation of said second pulse;

a third monostable multivibrator having an output terminal and generating, by being triggered by said third pulse, a fourth pulse corresponding to said interval of said second current; and switch means activating a current in said coil when said second and fourth pulses enter the control circuit.

7. A ball shooting apparatus for a pinball game machine as set forth in claim 6, in which said first monostable multivibrator comprises an RC circuit having a time constant, and a pulse width of said second pulse is changed by changing the time constant of said RC circuit thereby to control said interval of said first current for said coil.

8. A ball shooting apparatus for a pinball game machine as set forth in claim 7 comprising a manipulating knob varying the time constant of the said RC circuit.

9. A ball shooting apparatus for a pinball game machine as set forth in claim 6, in which said switch means comprises an OR circuit having an output signal, said OR circuit being connected to the output terminals of said first and third monostable multivibrators, and a transistor which turns on when the output signal of said OR circuit is at a high level.

* * * * *